United States Patent [19]

Kramer

[11] Patent Number: 4,526,293

[45] Date of Patent: Jul. 2, 1985

[54] TAMPER RESISTANT CLOSURE MEMBER

[76] Inventor: Steven G. Kramer, 60 El Verano Way, San Francisco, Calif. 94127

[21] Appl. No.: 462,514

[22] Filed: Jan. 31, 1983

[51] Int. Cl.[3] ..... B65D 83/04

[52] U.S. Cl. ..... 221/298; 206/540; 222/476

[58] Field of Search ..... 221/234, 235, 265, 289, 221/298, 288; 222/349, 350, 355, 450, 476, 437, 457; 206/534, 536, 540

[56] References Cited

U.S. PATENT DOCUMENTS

| | | | |
|---|---|---|---|
| 2,176,232 | 10/1939 | Warren et al. | 221/265 |
| 2,990,976 | 7/1961 | Fultz | 221/265 |
| 4,220,247 | 9/1980 | Kramer | 222/153 X |
| 4,228,920 | 10/1980 | Burton | 221/265 |
| 4,365,722 | 12/1982 | Kramer | 206/534 X |

*Primary Examiner*—F. J. Bartuska
*Attorney, Agent, or Firm*—Emrich & Dithmar

[57] ABSTRACT

A tamper resistant closure member adapted to be affixed to a dispensing container includes an inner housing affixed to the opening of the container. The inner housing has an opening and a recessed portion about the opening. A leaf member is positioned over the opening within the recess and is secured about its edge surface to the inner housing. An outer housing is rotatably nested over the inner housing. The outer housing includes an opening and a projection adjacent the opening. The projection is adapted to be received within the recess to engage and substantially close a leaf member as the opening of the outer housing is rotated in communication with the recess.

36 Claims, 12 Drawing Figures

TAMPER RESISTANT CLOSURE MEMBER

BACKGROUND OF THE INVENTION

The present invention relates to closure members for containers, vials and the like, and, more particularly, to closure members which are particularly well adapted for use on dispensing containers for medicinal agents.

There has been a marked interest in methods for providing a medication container enclosure which is tamper proof, child-proof, and which prevents the insertion or reinsertion of pills, tablets or capsules into the container vessel due to the recent tragedies involving medicinal capsules laced with cyanide. Current proposed systems to overcome tampering have involved seals of one kind or another which would be broken after the bottle is purchased. For example, medication bottles may be enclosed within a cardboard carton which is glued closed. However, such cardboard boxes may be opened and reglued relatively easily. Seals may also be placed underneath a twist off cap which can be punctured or peeled back upon purchase and use. However, such systems may be readily counterfeited, duplicated or peeled back and reglued in place after the bottle has been tampered with. Thus, the current solutions and systems do not solve the problems of store tampering or tampering once the container has been purchased and in use in the home.

The closure member of the present invention affords novel improvements over current solutions to the problems of tampering with medications. The invention bears some relationship to several principles taught in my previous U.S. Pat. No. 4,220,247 and to U.S. Pat. No. 4,365,722.

SUMMARY OF THE INVENTION

The present invention provides a closure member adapted to cover the opening of a container that will provide a tamper proof, child-proof, one way dispensing system for solid dosage forms such as pills, tablets, or capsules. A manufacturer may fill the container with the solid dosage form and seal the oontainer with the closure member such that no other solid dosage form can be inserted or reinserted into the container without destroying either the closure, container or the solid dosage form. The present invention affords protection during the dispensing life of the container.

Briefly, an embodiment of the present invention provides a tamper resistant closure member adapted to be affixed to a dispensing container for holding solid dosage forms comprising an inner housing adapted to be affixed to the opening of the dispensing container. The cylindrical inner housing has an end wall having an opening therein. The end wall defines an interior top surface towards the container and an exterior bottom surface away from the container. Surrounding the opening on the exterior bottom surface of the end wall is a recess. A leaf member is positioned over the opening of the inner housing on the exterior bottom surface of the end wall within the recess and is resiliently affixed about one of its edge surfaces to permit the leaf member to move from a first open position to a second closed position over the inner housing opening. A cylindrical outer housing is rotatably affixed over the inner housing. The outer housing includes an end wall defining an interior top surface towards the inner housing and an exterior bottom surface away from the inner housing. The interior top surface of the outer housing includes a projection projecting upward towards the exterior bottom surface of the inner housing. The projection is adapted to be received within the recess of the exterior bottom surface of the inner housing to engage the leaf member and provide an upward force against the leaf member to substantially close the leaf member over the opening in the inner housing end wall. The end wall of the outer housing includes an opening axially positioned to cooperate with the opening of the end wall of the inner housing. The opening on the outer housing is also positioned radially adjacent the outer housing projection to come into communication with the recess of the inner housing, clearing the leaf member, as the projection is received in the recessed portion engaging and substantially closing the leaf member.

As the opening of the outer housing is brought into the communication with the recess section, a dosage form is permitted to exit through the opening of the outer housing, while the projection, closing the leaf member prevents the insertion of foreign objects into the dispensing container. Continued rotation of the outer housing engages the projection with any foreign objects inserted into the dispensing section of the recess and causes the object to impact upon the terminal wall of the recessed portion. A ratchet mechanism incorporated into the inner and outer housing permits the outer housing to rotate in only one direction relative to the inner housing, permitting movements such that the outer housing opening precedes the adjacent projection past a fixed point upon the inner housing. The mechanism may not be backed up to release the leaf member.

The ratchet mechanism of the present invention may take many forms. One embodiment of the present invention includes one way abutment surfaces on one of the housings having interlocking inclined surfaces and end walls which cooperate with a ratchet projection on the opposite housing which engages the incline surfaces and abutment surfaces to allow one way movement. The abutment surfaces may be positioned about the end walls of the housings or may be incorporated into cylindrical portions of the respective inner and outer housings.

A further embodiment of the present invention includes an inner housing having an incline surface upon the inner surface of the end wall to channel tablets, capsules, or pills towards the opening in the end wall of the inner housing.

Another embodiment of the present invention includes a dispensing container which cooperates with the inner housing to prevent relative rotation of the inner housing and the container. The rim of the dispensing container and the inner surface of the cylindrical wall of the inner housing include interfitting tongue and groove surfaces. An inwardly projecting flange on the inner housing secures the inner housing to the rim of the dispensing container and cannot be removed without serious damage to the container or inner housing.

Embodiments of the present invention may be readily adapted for use with dispensing containers or solid dosage forms of different sizes and shapes. The operation of the present invention requires a knowledge of the ratchet mechanism and the need to invert the bottle during usage, operations which substantially impairs a child in obtaining medication from the dispensing container. Other press and turn child-proof features may be readily included in the disclosed structure. Thus, the present invention affords a tamper resistant closure member which may be latched to a container on which is mounted to render it difficult for a young child to open while providing a closure member that can be readily opened and closed by the average adult.

Other features and advantages of the present invention will be apparent from the following description and claims and are illustrated in the accompanying drawings, which, by way of illustration, show preferred embodiments of the present invention and the principles thereof in what are now considered to be the best mode to apply these principles. Other embodiments of the invention employing the same or equivalent principles may be used and structural changes may be made as desired by those skilled in the art without departing from the present invention and the purview of the appended claims.

DETAILED DESCRIPTION OF THE DRAWINGS

Figure 1:
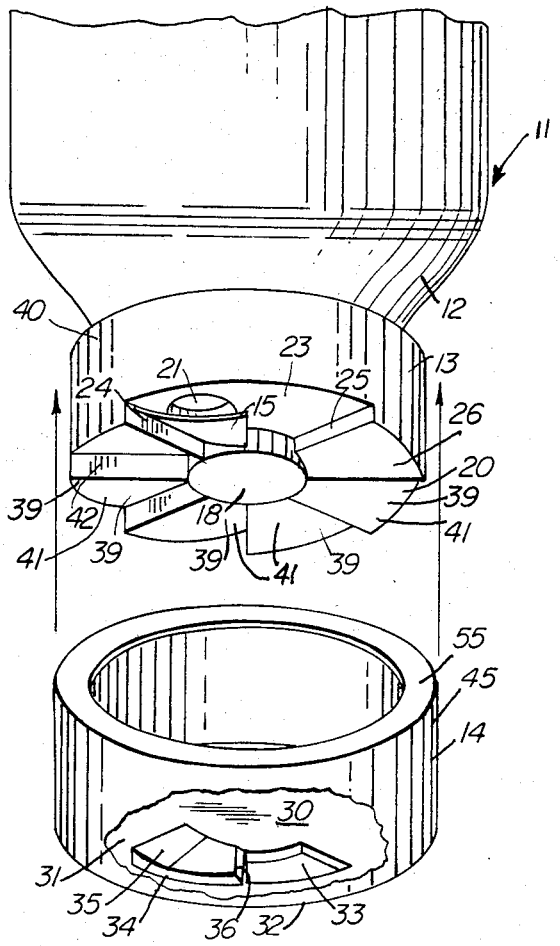
FIG. 1 is a side sectional exploded view of a closure member affixed to a dispensing container in accordance with the present invention.
Figure 2:
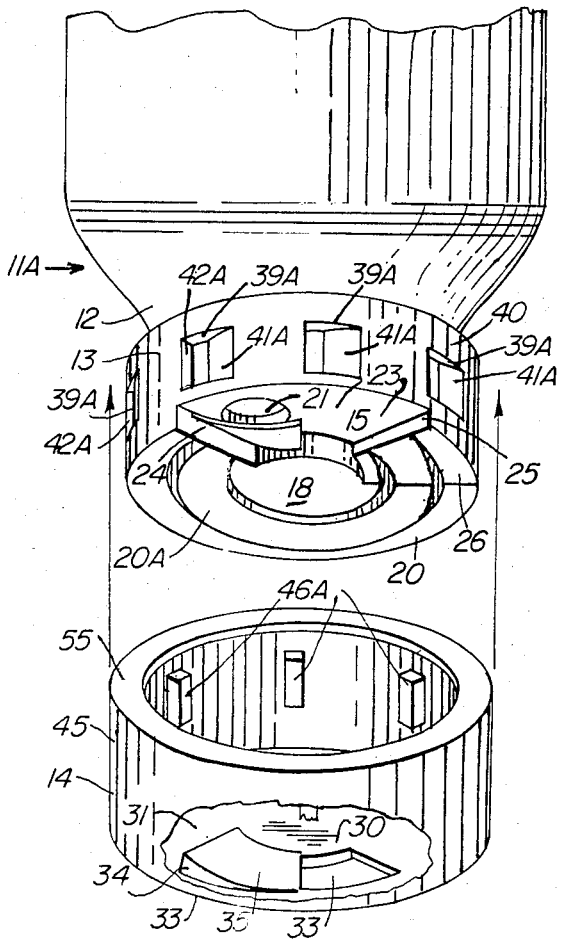
FIG. 2 is a sectional exploded view of a second closure member affixed to a dispensing container in accordance with the present invention.

A dispensing apparatus embodying the principles of the present invention, generally designated by numeral 11 in FIG. 1 and 11A in FIG. 2, is comprised of the following major components; a container 12, an inner housing 13, an outer housing 14 and a leaf member or obstruction means 15. The differences between the embodiments illustrated in FIGS. 1 and 2 will be discussed in detail shortly and features in the embodiment illustrated in FIG. 1 where they differ from the embodiment of FIG. 2 will be designated with the suffix A.

The inner housing 13 is adapted to be affixed to the opening (not shown) of the dispensing container 12. The inner housing 13 has an end wall 18 defining an interior top surface 19 towards the container 12 and an exterior bottom surface 20 away from the container 12. Preferably, the interior top surface 19 is slanted to channel the pills or tablets into the opening for removal from the container 12. The end wall includes an opening 21 through which a solid dosage form, such as a tablet, pill or capsule, may pass. The exterior bottom surface 20 of the inner housing 13 has a recess 23 positioned about the inner housing opening 21. The recess 23 has a forward wall 24 and a terminal wall 25. The forward wall 24 is positioned in close proximity to the inner housing opening 21. The recess 23 extends beyond the opening 21 to the terminal wall 25 positioned away from the opening a distance approximately equal to the size of the tablet, pill or capsule to be dispensed.

A resilient leaf member or obstruction means 15 is positioned over the opening 21 of the inner housing 13 within the recess 23. The leaf member 15 is resiliently affixed about one of its edge surfaces towards the forward wall 24 of the recess 23 to allow the leaf member 15 to move from a first closed position to a second open position over the inner housing opening 21.

The outer housing 14 includes an end wall 30 defining an interior top surface 31 towards the inner housing 13 and an exterior bottom surface 32 away from the inner housing 13. The outer housing end wall 30 includes an opening 33 axially positioned to cooperate with opening 21 and the inner housing end wall 18. The interior top surface 31 of the outer housing end wall 30 includes a projection 34 adjacent to the outer housing opening 33. The projection 34 is adapted to be received in the recess 23 on the exterior surface 20 of the inner housing 13 to engage and substantially close the leaf member 15 as the opening 33 of the outer housing 14 is rotated into communication with the recess 23 to allow a tablet, pill or capsule to exit through the outer housing opening. Foreign objects inserted into the recess 23 cannot be further inserted into the dispensing container while leaf member 15 is closed over the opening 21 in the end wall 18 of inner housing 13. Foreign objects remaining in the recess portion 23, upon further rotation of the outer housing, engage the projection 34 and are pushed forward until impact with the terminal end wall 25 of the recess 23. In addition, there is a ratchet mechanism within the structure which permits only one directional rotation of the inner and outer housings 13 and 14, as will hereinafter be described.

Referring now to FIG. 2, the ratchet mechanism of the dispensing apparatus 11A includes an inner housing 13 which includes a cylindrical wall 40 which encircles the circular end wall 18. Abutment grooves 39A are incorporated into the surface of the cylindrical wall 40 of the inner housing. The abutment grooves 39A include incline surfaces 41 and abutment walls 42A. The abutments wall 42A present substantially perpendicular surfaces to the rotation of movement of the outer housing 14. Although the abutment walls 42A are shown as being recessed they may also project outward from the cylindrical surface 40.

In the embodiment shown in FIG. 2, the outer housing 14 includes a cylindrical wall 45 surrounding the circular outer housing end wall 30 and proportioned to nest over the inner housing 13. The interior surface of the cylindrical wall 45 of the outer housing 14 includes ratchet projections 46A in alignment with the abutment grooves 39A when the outer housing is nested upon the inner housing 13, to cooperate and engage the grooves 39A to yieldingly resist movement in one direction as the ratchet projections move up and over the inclined surfaces 41A, and substantially prevent movement in the opposite direction when the ratchet projections 46A move down the incline surfaces 41A and impact upon the abutment wall 42A.

It will be recognized by those skilled in the art that there are numerous ways of providing one directional rotation of a nested inner and outer housing 13 and 14. For example, FIG. 1 illustrates an embodiment of the present invention wherein a ratchet mechanism is incorporated into the exterior surface 20 of the inner housing 13 and the interior surface 31 of the outer housing end wall 30. Projection 34 extending upward from the interior surface 31 of the outer housing end wall 30 is wedge-shaped, having an inclined face 35 and vertical surface 36, to allow the projection to slideably deflect over the inclined surfaces 41 in one rotational direction and non-yieldingly engage abutment walls 42 in the opposite direction.

Referring now to FIGS. 1 and *5a–d*, and the operation of the dispensing apparatus 11, the projection 34 includes a forward abutment surface 37 which cooperates with a terminal wall 25 of the recessed portion 23 to facilitate engagement with foreign objects within the recess. The terminal wall 25 of the recess portion 23 is shown in FIGS. 1, 2, *5a–d* and *6a–d* as having an inclined face 26 which cooperates with the projection 34 to facilitate the deflection of the projection 34 upon rotation with respect to the inner housing. It is preferred that the outer housing 14 be made of a relatively resilient and flexible material to permit the end wall 30 of the outer housing 14 to flex outward as the projection 34 slides over inclined surfaces 41 as shown in FIGS. 1 and *5a–d* or over the non-recessed portions of the exterior surface 20A of the inner housing 13 illustrated in FIGS. 2 and *6a–d*.

The forward wall 24 of recess 23 is substantially perpendicular to the movement of projection 34 to permit the projection 34 to snap into the recess 23 suddenly to engage leaf member 15. The inner housing opening 21 is rounded, best shown in FIGS. *5a–d* and *6a–d*, to permit tablets or other dosage forms to re-enter the dispensing container 12 as the leaf member 15 is engaged by the projection 34.

It will be recognized by those skilled in the art that the cooperation between the projection 34 of the outer housing 14 and the recess portion 23 of the inner housing and the leaf member 15 may take different forms. For example, a plurality of projections 34 may be received within concentrically shaped channels or grooves 20A (FIG. 2) recessed within the inner wall 18 of the inner housing 13. As the plurality of projections 34 rotate through the channels and enter the recess portion 23 the projections engage the leaf member closing the opening 21. If channels 20A are incorporated into the inner housing 13, the outer housing 14 will not need to accommodate the flexing action caused as the projection 34 travels across non-recessed areas 20 of the inner housing 13. Further rotation of the outer housing positions the projections in close proximity to the terminal wall 25 where the projections 34 and non-channeled portions of the terminal wall 25 engage any foreign inserted into the recess 23. A plurality of projection 34 may be spaced radially relative to the outer housing 14E to both sides of the outer housing opening 33 and laterally to engage and close the leaf member 15 at earlier points during the rotation and still provide a projection 34 for engaging for foreign objects. Alternatively, a single projection 34 may be extended forward on each side of the opening 33.

It is also within the scope and teaching of the present invention that the dispensing apparatus may include an opening 21, a recess 23, a forward wall 24 and terminal wall 25 positioned radially on the cylindrical surface 40 of the inner housing 13. Thus, in a similar manner previously described, the outer housing 14 includes a cylindrical wall 45, an opening 35 (not shown), a projection 34 (not shown), an inclined face 35 and vertical surface 36. Importantly, an obstruction means 15 may be positioned between an opening 21 (not shown) on the cylindrical surface 40 of the inner housing 31 and the opening 33 (not shown) on the cylindrical surface 45 of the outer housing 14 to prevent foreign objects from passing into the interior of the container 12. In such an embodiment, the tablets or pills are dispensed outwardly from the sides of the inner and outer housings. It is also within the purview of the present invention to have openings and features of one end wall of one housing cooperating with features and openings on the cylindrical wall of the other housing.

Figure 3:
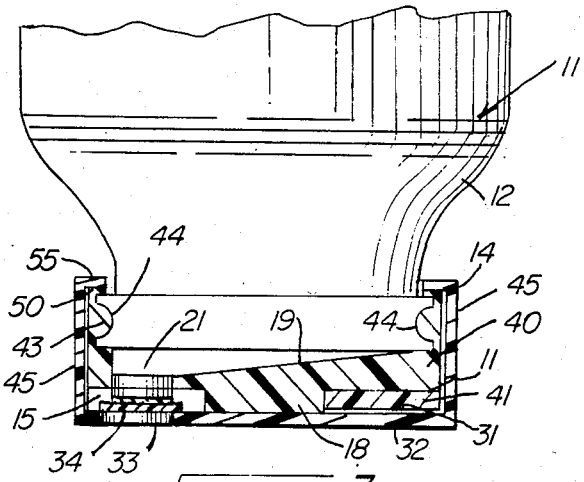
FIG. 3 is a sectional side view of the closure member of FIG. 1.
Figure 4:
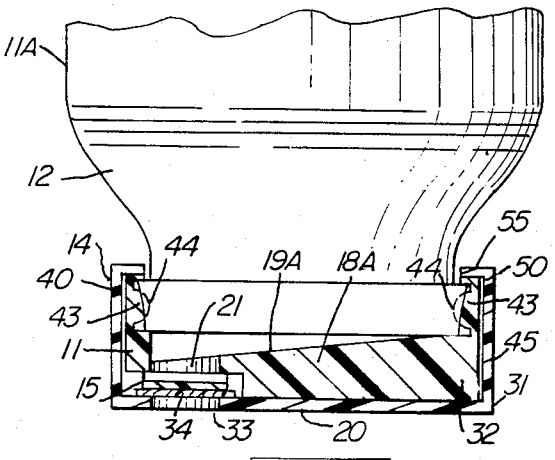
FIG. 4 is a sectional side view of the closure member of FIG. 2.
Figure 5A:
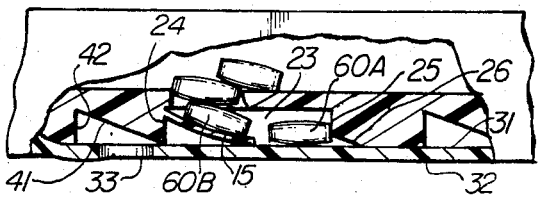
FIGS. 5*a–d* illustrate a sequence of rotation of the outer housing relative to the inner housing of the closure member of FIG. 1; and, FIG. 6*a–d* illustrate a sequence rotation of the outer housing relative to the inner housing of the enclosure member of FIG. 2.
Figure 6A:
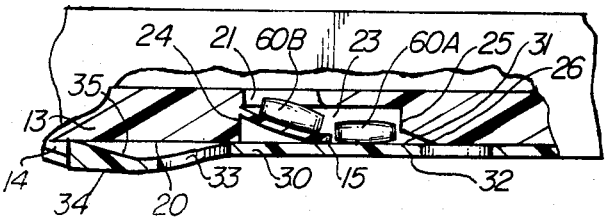
Figure 5B:
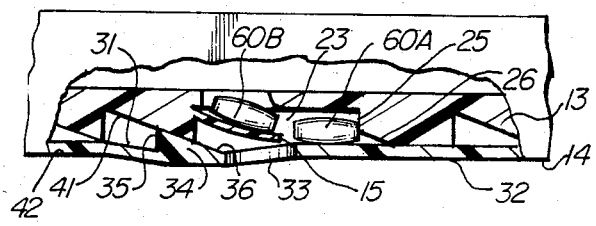
Figure 6B:
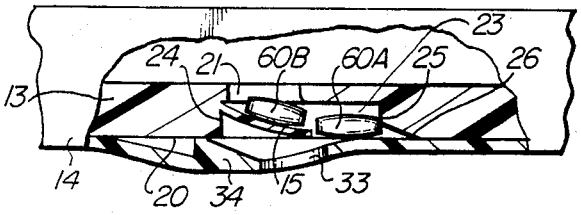
Figure 5C:
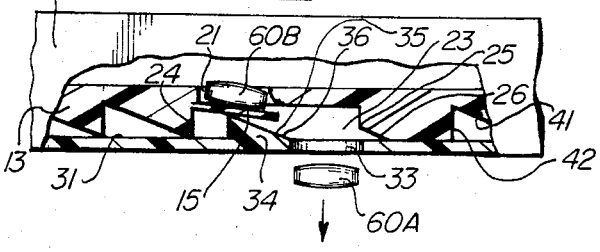
Figure 6C:
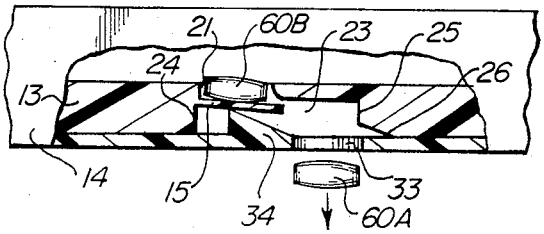
Figure 5D:
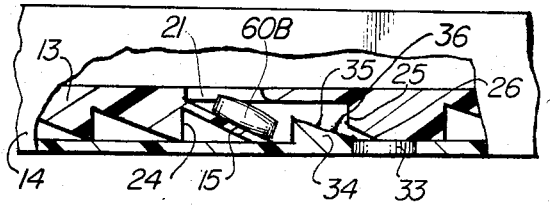
Figure 6D:
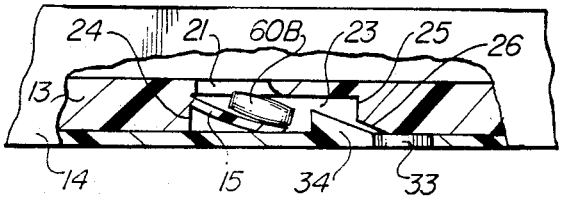

Referring now to FIGS. 3 and 4, the dispensing container 12 is, preferrably, immovably secured to the inner housing 13 to prevent the removal of the closure member 16 from the container 12. Thus, the inner surface of the inner housing cylindrical wall 40 may be provided with threads (not shown) which cooperate with corresponding threads (not shown) on dispensing container 12 and secured by glue or other suitable adhesive. The embodiments, as illustrated in FIGS. 3 and 4, include an inner housing cylindrical wall 40 having a inwardly projecting tongue 43 which are received within a cooperating grooves 44 in the rim of the dispensing container 12. Inner housing 13 is further secured to the dispensing container by an inner housing rim 50 which projects radially inwardly over a cooperating lip 51 on the dispensing container opening.

Similarly the outer housing 14 is rotatably secured to the inner housing 13 by means of a radially inwardly projecting rim 55 which overlaps and engages the cylindrical wall 40 of the inner housing 13. The inner housing 13 may not be removed from the dispensing container 12 and the outer housing 14 may not be removed from the inner housing 13 without imparting structural damage to the components which would alert the purchaser or user of the medication of tampering of the container 12.

Referring now to FIG. 4, the inner housing 13 of a dispensing apparatus 11A includes an end wall 18A having an inclined interior surface 19A. The inclined interior surface funnels upward from the opening 21 in the inner housing end wall 18A to channel tablets, pills and capsules towards the opening while the dispensing container is an inverted dispensing position.

In operation, the dispensing apparatus 11 or 11A is held in an inverted position with one hand holding the dispensing container 12 and the other hand holding the outer housing 14. The dispensing container 12 and inner housing 13 are rotated relative to the outer housing 14 to provide a sequence of steps to take place as illustrated in FIGS. *5a–d* and *6a–d*. Referring now to FIGS. *5a–d* and *6a–d*, a plurality of tablets 60 previously contained upon the interior surface 19 of end wall 18 have worked their way towards and through the opening 21. One tablet 60A has fallen within the recess portion 23 and rests towards the terminal wall 25. A second tablet 60B rests upon the surface of leaf member 15.

Continued rotation of the outer housing 14 relative to the inner housing 13 rotationally moves the projection 34 along the exterior surface 20 of the inner housing 13, as shown in FIGS. *5b* and *6b*. The embodiment illustrated in FIG. *5b* moves up the inclined surface 41 but is substantially prevented from movement in the opposite direction by the engagement of abutment wall 42 with the vertical surface 36 of the projection 34. As the projection 34 moves up the inclined surface 41 on the exterior surface 20 of the end wall 18, the outer housing 14 flexes outward. In the embodiment illustrated in FIG. *6b*, the projection 34 merely slides along the exterior surface 20A of inner housing 13.

As shown in FIGS. *5c* and *6c*, further rotation of the outer housing 14 relative to the inner housing 13 positions the projection 34 into communication with the recess 23 of the inner housing 13. The forward wall 24 of the recess 23 is substantially vertical to permit the projection 34 to engage leaf member 15 to close opening 21 in the inner housing 13 whereby the second tablet received within the recess 60B is pushed back upward through the opening 21. Opening 21 in inner housing end wall 18 is provided with a rounded surface to permit tablets to slide easily back upward upon the closing of the leaf member 15. Outer housing opening 33, now in communication with the recess 23 and clear of leaf member 15 permits the first tablet 60A to drop through. Foreign objects inserted through opening 33 in the outer housing end wall 30 are received within the recessed portion 23 but are unable to pass into the interior of the container 12 due to the closed leaf member 15.

Further rotation of the inner housing 13 relative to the outer housing 14 will cause a foreign object to be compressed within the area between the projection 34 and the terminal wall 25 of the recess portion 23, as illustrated in FIGS. *5d* and *6d*. Projection 34 moves beyond the leaf member 15 which is allowed to fall back to the interior surface 31 of outer housing end wall 30 allowing a second tablet 60B to drop through opening 21 of inner housing end wall 18. Further rotation of the outer housing 14 relative to the inner housing 13 causes projection 34 to be withdrawn from the recess portion 23 onto the exterior surface 20 of inner housing 13 as illustrated in FIGS. *5a* and *6a* to repeat the cycle.

The user of the dispensing apparatus 11 or 11A in accordance with the present invention is protected not only while the medication is on the store or pharmacy shelf, but as long as the dispensing container 12 contains medication. Tampering cannot be achieved without removing the inner or outer housings 13 and 14 which would require structural damage which would immediately alert the user to such tampering.

The operation of the present invention requires a knowledge of the ratchet mechanism and the need to invert the bottle which in themselves would substantially impair a child in obtaining medication from the container. Other press and turn child-proof features may be readily added to the disclosed structure without impairment of function, as is known in the art.

Having thus disclosed preferred embodiments of the invention, persons skilled in the art will be able to modify the structure which has been disclosed and to substitute equivalent elements for those described while continuing to practice the principles of the invention; and it is therefore, intended that all such modifications and substitutions be covered and embraced within the spirit and scope of the appended claims.

I claim:

1. A tamper resistant closure member adapted to be affixed to a dispensing container having an opening therein, which container is for holding solid dosage forms comprising:

an inner housing adapted to be fixedly mounted to an opening of the dispensing container, said inner housing having an end wall defining an interior surface towards said container and an exterior surface away from said container, said end wall including an opening therein through which the solid dosage form may pass, said exterior surface having a recess thereon, said recess having a forward wall and a terminal wall, said recess being positioned about said inner housing opening with said forward wall in close proximity to said inner housing opening and extending across said inner housing opening to said terminal wall positioned away from said inner housing opening, obstruction means cooperating with said inner housing opening within said recess, and resiliently fixed towards said forward wall of said inner housing, to permit said obstruction means to move from a first closed position over said inner housing opening to a second open position, an outer housing rotatably affixed to said inner housing, said outer housing having an end wall defining an interior surface towards said inner housing and an exterior surface away from said inner housing, said outer housing end wall having an opening axially positioned to cooperate with said inner housing opening on said inner housing end wall, said interior surface of said outer housing including projection means thereon adjacent to said outer housing opening and adapted to be received in said recess to engage and substantially close said obstruction means as said opening of said outer housing is rotated in communication with said recess to permit a dosage form to exit through said outer housing opening, said projection means for engaging foreign objects inserted in said outer housing opening and impacting said foreign objects upon said terminal end of said recess; and, ratchet means affixed to said inner and outer housings thereby permitting said outer housing to rotate only in one direction relative to said inner housing.

2. The tamper resistant closure member in accordance with claim 1 wherein said ratchet means is interposed between said inner and outer housings and includes abutment surfaces and ratchet projections, said abutment surfaces incorporated into one of said surfaces of one of said housings and having abutment grooves including inclined surfaces and terminal abutment walls therewith, said abutment walls substantially perpendicular to the relative movement of said housings, said ratchet projection positioned on said opposite housing in alignment with said abutment surfaces to cooperate and engage said abutment grooves to yieldingly resist movement in one direction as said ratchet projection move along said inclined surfaces, and substantially to prevent movement in the opposite direction when said abutment wall and ratchet projections are engaged.

3. The tamper resistant closure member in accordance with claim 1 wherein said interior surface of said inner housing includes an inclined surface, said inclined surface funneling upward from said opening in said inner housing end wall to channel the solid dosage forms towards said inner housing opening.

4. The tamper resistant closure member in accordance with claim 1 wherein said inner housing includes a cylindrical wall substantially surrounding the rim of said dispensing container, said cylindrical wall having tongue and groove surfaces which cooperate with corresponding tongue and groove surfaces on said dispensing container to prevent the relative rotation of said dispensing container and the inner housing.

5. The tamper resistant closure member in accordance with claim 4 wherein said inner housing cylindrical wall includes a radially inwardly projecting inner housing rim for fixedly mounting said inner housing to said rim of a dispensing container.

6. The tamper resistant closure member in accordance with claim 1 wherein said inner housing includes a cylindrical wall, and said outer housing further comprises a cylindrical wall including a radially inwardly projecting outer housing rim, said inner housing rotatably nesting within said outer housing rotatably and retained by said outer housing rim.

7. A tamper resistant closure member in accordance with claim 1 wherein said projection means of said outer housing is wedge shaped.

8. The tamper resistant closure member in accordance with claim 1 wherein said terminal wall of said recessed portion includes an inclined surface to slidably deflect said projection means.

9. The tamper resistant closure member in accordance with claim 1 wherein said forward wall of said recess is substantially perpendicular to the movement of said projection means to provide a sudden engagement of said projection means with said leaf member upon rotation of the outer housing.

10. The tamper resistant closure member in accordance with claim 1 wherein said projection is wedge shaped and said ratchet mechanism further includes inclined surfaces and abutment walls upon the exterior surface of said inner housing which engage said wedge shaped projection thereby permitting one way rotation of said outer housing relative to said inner housing.

11. The tamper resistant closure member in accordance with claim 1 wherein said terminal wall of said recess includes an abutment surface, said abutment surface positioned substantially perpendicular to the movement of said outer housing projection to thereby engage and to prevent the insertion of foreign objects into the closure member.

12. The tamper resistant closure member in accordance with claim 1 wherein said inner housing further comprises a channel, said channel concentric with the rotational axis of said outer housing and aligned with said leaf member to receive said projection means, said projection means rotating within said channel as said outer housing rotates relative to said inner housing.

13. The tamper resistant closure member in accordance with claim 12 wherein said channel is narrower than said solid dosage form.

14. The tamper resistant closure member in accordance with claim 1 wherein said projection means extends laterally forward of said outer housing opening relative to its movement to close said leaf member.

15. The tamper resistant closure member in accordance with claim 1 wherein said obstruction means includes a leaf member.

16. A tamper resistant closure apparatus for holding at least one solid dosage form comprising:

a dispensing container having an opening and a rim;

a cylindrical inner housing adapted to be affixed to the opening of said dispensing container, said inner housing having an end wall and a cylindrical wall, said end wall having an interior surface towards the container and an exterior surface away from said container, said end wall including an inner housing opening through which said solid dosage form may pass and said exterior surface having a recess therein, with said recess having a forward wall and a terminal wall, and said recess positioned about said inner housing opening, with said forward wall of said recess in close proximity to said inner housing opening and said recess extending across said inner housing opening to said terminal wall positioned away from said inner housing opening;

inner housing affixing means including tongue and groove surfaces about the interior cylindrical wall of inner housing and the outer surface of said dispensing container rim;

a leaf member having edge surfaces thereon positioned over said inner housing opening within said recess and resiliently affixed about one of said edge surfaces towards said forward wall to permit said leaf member to move from a first closed position to a second open position over said inner housing opening;

an outer housing rotatably affixed to said inner housing, said outer housing having an end wall defining an interior surface towards said inner housing and an exterior surface away from said inner housing, with said outer housing end wall having an outer housing opening axially positioned to cooperate with said inner housing opening on said inner housing end wall and with said interior surface of said outer housing including projection means adjacent to said outer housing opening adapted to be received in said recess to engage and substantially close said leaf member as said outer housing opening is rotated in communication with said dispensing section to allow a dosage form to exit through said outer housing opening, said projection means for engaging foreign objects inserted in said outer housing opening and impacting said foreign objects upon said terminal end of said recess; and, ratchet means affixed to said inner and outer housings allowing said outer housing to rotate in one direction relative to said inner housing, said outer housing opening preceding said adjacent projection as said outer housing is rotated past a fixed position on said inner housing.

17. The tamper resistant closure apparatus in accordance with claim 16 wherein said inner housing cylindrical wall further comprises an inwardly projecting flange which engages and secures said dispensing container rim to said inner housing.

18. A tamper resistant closure member adapted to be affixed to a dispensing container having an opening therein, which container is for holding solid dosage forms comprising:

an inner housing adapted to be fixedly mounted to an opening of the dispensing container, said inner housing having an interior surface and an exterior surface and including an inner housing opening therein through which the solid dosage form may pass, with said exterior surface having a recess in communication with said inner housing opening;

obstruction means movably positioned in cooperation with said opening of said inner housing to permit said obstruction means to move from a first closed position over said inner housing opening to a second open position;

an outer housing rotatably affixed to said inner housing, said outer housing having an interior surface towards said inner housing and an exterior surface away from said inner housing and including an outer housing opening therein positioned to cooperate with said inner housing opening said interior surface of said outer housing including projection means positioned to engage and substantially close said obstruction means as said outer housing opening is rotated in communication with said recess to permit a dosage form to exit through said outer housing opening; and ratchet means affixed to said inner and outer housings thereby permitting said outer housing to rotate only in one direction relative to said inner housing.

19. The tamper resistant closure member in accordance with claim 18 wherein said walls of said inner and outer housings are cylindrical.

20. The tamper resistant closure member in accordance with claim 18 wherein said inner housing includes an end wall with said interior surface thereof towards the opening in the dispensing container and said exterior surface thereof away from the opening in the dispensing container and said recess therein having a forward wall and a terminal wall and being positioned about said inner housing with said forward wall in close proximity to said inner housing opening and extending across said inner housing opening to said terminal wall positioned away from said inner housing opening.

21. The tamper resistant closure member in accordance with claim 20 wherein said obstruction means is positioned within said recess in said inner housing and is resiliently fixed towards said forward wall of said inner housing.

22. The tamper resistant closure member in accordance with claim 20 wherein said outer housing includes an end wall with said interior surface thereof towards said inner housing and said exterior surface thereof away from said inner housing, and said outer housing opening axially positioned within said outer housing end wall to cooperate with said inner housing opening with said interior surface of said outer housing including projection means thereon adjacent to said outer housing opening and adapted to be received in said recess to engage and substantially close said obstruction means as said outer housing opening is rotated in communication with said recess to permit a dosage form to exit through said outer housing opening, said projection means for engaging foreign objects inserted in said outer housing opening and impacting said foreign objects upon said terminal end of said recess; and ratchet means affixed to said inner and outer housings thereby permitting said outer housing to rotate only in one direction relative to said inner housing.

23. The tamper resistant closure member in accordance with claim 22 wherein said ratchet means is positioned between said inner and outer housings and includes abutment surfaces and ratchet projections, said abutment surfaces incorporated into one of said surfaces of one of said housings and including inclined surfaces and terminal abutment walls, said abutment walls substantially perpendicular to the relative movement of said housings, said ratchet projection positioned on said opposite housing in alignment with said abutment surfaces to cooperate and engage said grooves to yieldingly resist movement in one direction as said ratchet projection move along said inclined surfaces, and substantially to prevent movement in the opposite direction when said abutment wall and ratchet projections are engaged.

24. The tamper resistant closure member in accordance with claim 22 wherein said interior surface of said inner housing includes an inclined surface, said inclined surface funneling upward from said opening in said inner housing end wall to channel the solid dosage forms towards said inner housing opening.

25. The tamper resistant closure member in accordance with claim 22 wherein said inner housing includes a cylindrical wall substantially surrounding the rim of said dispensing container, said cylindrical wall having tongue and groove surfaces which cooperate with corresponding tongue and groove surfaces on said dispensing container to prevent the relative rotation of said dispensing container and the inner housing.

26. The tamper resistant closure member in accordance with claim 25 wherein said inner housing cylindrical wall includes a radially inwardly projecting inner housing rim for fixedly mounting said inner housing to said rim of a dispensing container.

27. The tamper resistant closure member in accordance with claim 22 wherein said inner housing includes a cylindrical wall, and said outer housing further comprises a cylindrical wall including a radially inwardly projecting outer housing rim, said inner housing rotatably nesting within said outer housing rotatably and retained by said outer housing rim.

28. A tamper resistant closure member in accordance with claim 22 wherein said projection means of said outer housing is wedge shaped.

29. The tamper resistant closure member in accordance with claim 22 wherein said terminal wall of said recessed portion includes an inclined surface to slidably deflect said projection means.

30. The tamper resistant closure member in accordance with claim 22 wherein said forward wall of said recess is substantially perpendicular to the movement of said projection means to provide a sudden engagement of said projection means with said leaf member upon rotation of the outer housing.

31. The tamper resistant closure member in accordance with claim 22 wherein said projection is wedge shaped and said ratchet mechanism further includes inclined surfaces and abutment walls upon the exterior surface of said inner housing which engage said wedge shaped projection thereby permitting one way rotation of said outer housing relative to said inner housing.

32. The tamper resistant closure member in accordance with claim 22 wherein said terminal wall of said recess includes an abutment surface, said abutment surface positioned substantially perpendicular to the movement of said outer housing projection to thereby engage and to prevent the insertion of foreign objects into the closure member.

33. The tamper resistant closure member in accordance with claim 22 wherein said inner housing further comprises a channel, said channel concentric with the rotational axis of said outer housing and aligned with said leaf member to receive said projection means, said projection means rotating within said channel as said outer housing rotates relative to said inner housing.

34. The tamper resistant closure member in accordance with claim 33 wherein said channel is narrower than said solid dosage form.

35. The tamper resistant closure member in accordance with claim 22 wherein said projection means extends laterally forward of said outer housing opening relative to its movement to close said leaf member.

36. The tamper resistant closure member in accordance with claim 22 wherein said obstruction means includes a leaf member.

* * * * *

UNITED STATES PATENT AND TRADEMARK OFFICE

CERTIFICATE OF CORRECTION

PATENT NO. : 4,526,293

DATED : July 2, 1985

INVENTOR(S) : Steven G. Kramer

It is certified that error appears in the above-identified patent and that said Letters Patent is hereby corrected as shown below:

Column 1, line 42, delete "oontainer", insert --container--;
Column 4, line 37, delete "abutments wall", insert --abutment walls--;
Column 4, line 56, delete "wall", insert --walls--;
Column 5, line 45, after "foreign" insert --objects--;
Column 5, line 46, delete "projection", insert --projections--;
Column 6, line 15, delete "a", insert --an--;
Column 6, line 16, delete "are", insert --is--;
Column 6, line 17, delete "grooves", insert --groove--;
Column 6, line 38, after "is" insert --in--;
Column 8, line 43, delete "move", insert --moves--;
Column 11, line 55, delete "move", insert --moves--.

Signed and Sealed this

*Twenty-second* Day of *October 1985*

[SEAL]

*Attest:*

*Attesting Officer*

DONALD J. QUIGG

*Commissioner of Patents and Trademarks—Designate*